US006179281B1

(12) United States Patent
Pilsl et al.

(10) Patent No.: US 6,179,281 B1
(45) Date of Patent: Jan. 30, 2001

(54) METHOD AND DEVICE TO CONTROL EJECTION OF SHEETS FROM INPUT COMPARTMENTS IN A PAPER OUTPUT DEVICE BELONGING TO A PRINTING AND PHOTOCOPYING SYSTEM

(75) Inventors: Stephan Pilsl, Roehrmoos; Bernward Heller, Kirchheim; Gerhard Oberhoffner, Munich, all of (DE)

(73) Assignee: Océ Printing Systems GmbH, Poing (DE)

( * ) Notice: Under 35 U.S.C. 154(b), the term of this patent shall be extended for 0 days.

(21) Appl. No.: 09/284,762

(22) PCT Filed: Oct. 21, 1997

(86) PCT No.: PCT/DE97/02447

§ 371 Date: Jun. 18, 1999

§ 102(e) Date: Jun. 18, 1999

(87) PCT Pub. No.: WO98/18051

PCT Pub. Date: Apr. 30, 1998

(30) Foreign Application Priority Data

Oct. 22, 1996 (DE) ..... 196 43 620

(51) Int. Cl.[7] ..... B65H 3/44; G03G 15/00

(52) U.S. Cl. ..... 271/9.03; 399/23; 399/391

(58) Field of Search ..... 271/9.03, 9.02, 271/9.04, 9.05, 9.06; 355/23, 391

(56) References Cited

U.S. PATENT DOCUMENTS

| | | | | |
|---|---|---|---|---|
| 4,855,788 | * | 8/1989 | Fujii | 399/391 |
| 4,918,418 | | 4/1990 | Inage et al. . | |
| 4,992,882 | | 2/1991 | Ikenoue et al. . | |
| 5,056,769 | * | 10/1991 | IKenoue et al. | 271/9.03 |
| 5,991,556 | * | 11/1999 | Yamashita | 399/23 |
| 6,010,261 | * | 1/2000 | Maekawa | 271/9.03 |

FOREIGN PATENT DOCUMENTS 0 400 525 12/1990 (EP) .

OTHER PUBLICATIONS

Abstract of Japanese Published Application 60–188245, *Patent Abstracts of Japan* , vol. 010, No. 033 (M452), Feb. 8, 1986.

* cited by examiner

*Primary Examiner*—John M. Jillions
(74) *Attorney, Agent, or Firm*—Schiff Hardin & Waite

(57) ABSTRACT

In order to control the ejection of sheets from input compartments in a paper output device belonging to a printing or photocopying system, verification occurs as to whether a previously processed sheet has been removed as soon as it has been established that at least one input compartment is almost empty. Ejection of the sheet immediately following according to the order of processing occurs thereafter. These steps are repeated until the input compartment is empty. The printing operation is then stopped.

16 Claims, 3 Drawing Sheets

METHOD AND DEVICE TO CONTROL EJECTION OF SHEETS FROM INPUT COMPARTMENTS IN A PAPER OUTPUT DEVICE BELONGING TO A PRINTING AND PHOTOCOPYING SYSTEM

This application is a 371 of PCT/DE97/02447 filed Oct. 21, 1997.

BACKGROUND OF THE INVENTION

The invention is directed to a method and to an apparatus for controlling the output of sheets from input compartments of a sheet output means of a printer and copier device. The invention is also directed to a sheet output means for the implementation of the method which means comprises at least two input compartments, each having a means for removing a single sheet therefrom, a controller for actuating the means for removal and a sheet transfer means having a conveying path for transporting a sheet from the means for removal to the printing or copier device.

A plurality of input compartments in which sheets to be printed or other matter to be printed are inserted are usually provided in a sheet output means, particularly given high-performance printer and copier devices; and only "sheets" shall be mentioned below in this context. Sheets are taken from the input compartments and conveyed to processing devices of the printer and copier devices with conveyer means.

Thus, for example, JP-A-60-188 245 discloses a sheet output means for a copier device that is equipped with two input compartments for accepting sheets. A removal means with which an individual sheet can be respectively taken from the respective input compartment is provided at each input compartment. The removal means of the input compartments are actuated by a controller according to a predetermined sheet removal sequence. During operation of the sheet output means, the controller checks whether at least one of the input compartments is to be defined as nearly empty. As soon as one of the input compartments is defined as empty, only the removal means of the other input compartment that still contains enough sheets is activated by the controller. When both input compartments are almost empty, sheets are taken successively from both input compartments until the input compartments are empty.

A plurality of input compartments are not only provided in order to increase the capacity of a printer and copier means in that sheets can be successively taken from different input compartments as soon as the preceding compartment is empty, but also so that different printing matter, for example, differently colored sheets, sheets with a differently colored pre-print, sheets of a different format such as forms and the like, can be accommodated in the individual input compartments. For example, white sheets can be provided in one compartment, sheets provided with a company logo can be provided in a further compartment, personalized or color sheets can be provided in a third compartment etc.

Printing or copying jobs wherein different sheets must be accessed can thus be implemented with the assistance of a correspondingly designed control in that different input compartments are selected in a very specific sequence.

When a plurality of input compartments are provided in a sheet output means, then the transport paths for the individual input compartments of the sheet output means up to, for example, a sheet transfer location at which the sheets are output to the following printer and copier means differ in length. When the sheets are removed from the individual compartments in the same sequence in which they are processed, comparatively large distances, i.e. gaps, can derive between the individual sheets due to what are frequently transport paths of very different lengths.

In order to avoid such large gaps between individual sheets when conveying to the sheet transfer location or, respectively, to the printer and copier device, the transport paths of different length and the duration of a sheet transport from the individual compartments to the sheet transfer location that differs in length as a result thereof can be taken into consideration.

For example, a sheet from an input compartment from which a long transport path must be traversed up to the sheet transfer location can be removed earlier than a sheet from an input compartment from which a relatively short transport path must be traversed, even though the sheet removed later is processed before the sheet removed earlier.

The sequence in which the individual sheets are removed from the input compartments, which is referred to below as sheet removal sequence, can thus differ from the sequence in which the sheets are processed, which is referred to below as sheet processing sequence. As a result of an appropriately designed control, however, the distance between the individual sheets can be minimized or, respectively, an occurrence of large gaps can be avoided and, thus, the performance capability of high-performance printer and copier devices can be further-enhanced.

Even given an optimally designed control, however, problems can arise when a compartment is empty and this is discovered too late. When, for example, a sheet to be processed later in the processing sequence and that must cover a comparatively long transport path is removed from an input compartment earlier than a sheet to be processed earlier in the processing sequence and that must cover a comparatively short transport path, then the problem can occur that the sheet that is taken later from the corresponding compartment but is to be processed earlier in the processing sequence can no longer be taken since the corresponding input compartment is empty. In such an instance, the sheet processing sequence can no longer be adhered to.

The above problem is illustrated below with reference to a simple example (see FIG. 1). For the implementation of a printing job, sheets are needed from a compartment B and from a compartment D, these to be processed in the sequence $B_1$-$B_2$-$D_1$. $B_1$ thereby references a first sheet from the compartment B, $B_2$ references a second sheet from the compartment B, and $D_1$ references a sheet from the compartment D.

The compartment D is at a considerably greater distance from the sheet transfer location then the compartment B. For optimizing the printing and copying time, a removal sequence $D_1$-$B_1$-$B_2$ is therefore expedient. It is also assumed that only one sheet is still present in the compartment B.

The device controller is then designed, for example, such that the sheet $D_1$ is taken from the compartment D at the same point in time as the sheet $B_1$ from the compartment B. Due to the assumption that only one sheet is still present in the compartment B, the compartment B is now empty. The second sheet $B_2$ can thus no longer be taken from the compartment B and the processing sequence $B_1$-$B_2$-$D_1$ can therefore also no longer be adhered to.

FIG. 2 shows a diagram of a device controller that sees to it that the processing sequence $B_1$-$B_2$-$D_1$ is adhered to. To this end, the sheet output times or, respectively, points in time are entered on the ordinate in FIG. 2 and the path that a sheet must traverse from the respective compartment up to the sheet transfer location 10 (in FIG. 1) is entered on the abscissa.

As can be derived from the diagram in FIG. 2, the sheet $B_1$, with reference to the zero point of the diagram is removed from the input compartment B after a time 1.5 s and is transported along a transport path b identified with a directional arrow. V $B_1$ and $HB_1$ thereby reference the leading or, respectively, trailing edge of the sheet $B_1$. At time 2.3 s, the sheet $B_1$ has reached the sheet transfer location 10 (FIG. 1), where the transport path b (0 mm) ends, as indicated on the abscissa of the diagram of FIG. 2.

In order to keep these spaces between the sheets to be printed in the processing sequence $B_1$-$B_2$-$D_1$ as small as possible, the sheet $D_1$ is removed from the input compartment D at the same point in time at which the sheet $B_1$ was taken from the compartment B.

Due to the assumption that only one sheet is still present in the input compartment B, a sensor S allocated to the compartment B reports—after the sheet $B_1$ has been taken—that the input compartment B is now empty. (For this reason, leading and trailing edge $VB_2$ or, respectively, $HB_2$ of the sheet $B_2$ are merely shown with broken lines in FIG. 2.) This is detected at a point in time that corresponds to approximately 1.9 s on the ordinate.

At this time, however, the sheet $D_1$ taken from the input compartment D is located, for example, at the location P on a transport path d identified by a directional arrow.

Since the compartment B is empty and a second sheet $B_2$ can thus not be removed, the processing sequence $B_1$-$B_2$-$D_1$ can also not be adhered to and the printer and copier means is or, respectively, must be stopped.

After the printer and copier means has been stopped, at least the sheets of a print job that have already been taken from the respective output compartments must be removed from the printer and copier device by the operating personnel. In the above-described exemplary case, this is the sheet $D_1$. Over and above this, control problems in the following printing and copying operations can occur in that the controller does not know which sheets and how many sheets were removed from the printer and copier device by the operating personnel.

SUMMARY OF THE INVENTION

It is therefore an object of the invention to create a simple method for controlling the output of sheets from input compartments of a sheet output means of a printer and copier device, with which it is assured that the introduction of sheets is user-friendly. Further, a sheet output means for the implementation of the method should be created.

In a method for controlling the output of sheets from input compartments of a sheet output means of a printer and copier device, this object is inventively achieved by a method for controlling the output of sheets from input compartments of a sheet output means of a device, such as a printer or copier. The method has the steps of taking sheets in a sheet removal sequence from the various compartments, which sequence differs from the sheet processing required in the device, carrying out a check to determine whether a minimum number of sheets are still in the input compartment for the next sheet removal sequence, and, when any compartment is determined as almost empty, carrying out the next removal sequence only if enough sheets are still present. The invention is also directed to a sheet output means for the implementation of the method, this object is inventively achieved by a device having at least two input compartments for accepting sheets, removal means for each input compartment to remove a single sheet at a time, control means for activating the removal means in a sheet removal sequence and for determining if any compartment is almost empty, sheet transfer means between each input compartment to a transfer location to transfer the sheets to the device, such as a printer or copier, in a sheet processing sequence, which differs from removal sequence, and the control means only activating the removal means of the input compartment that is almost empty after checking to determine if the required sheets are still present for the removal sequence.

In the inventive method for controlling the output of sheets from input compartments of a sheet output means of an electrophotographic printer and copier device, all input compartments are constantly monitored to see whether an input compartment is almost empty. As soon as it has been found that at least one of the input compartments is almost empty, the printer and copier operations are arrested and the device controller checks whether a sheet preceding in the predetermined processing sequence has already been removed or is still in the corresponding input compartment.

Following thereupon, a next sheet in the processing sequence is taken from an input compartment. The above steps are repeated until an input compartment is empty. This, however, can be prevented in that appropriate sheets are replenished in time in the compartment reported as being nearly empty. When this is overlooked or, respectively, is not undertaken for some reason or other, the electrophotographic printer and copier operations can be arrested as soon as an input compartment is in fact empty.

According to the invention, the constant checking of the input compartments to see whether one of them is almost empty has the particular advantage that the operator merely has to introduce appropriate printing matter into the almost empty or, respectively, empty compartment as soon as this is indicated or, respectively, no later then when printer and copier operations have been stopped. Since the processing sequence has not yet been disturbed at this point in time given employment of the inventive method since no specified single sheet in the sequence is missing, sheets belonging to a print job and already taken from the input compartments need not be removed from the paper output means or, respectively, potentially, even from the printer and copier device.

According to an advantageous development of the inventive method, a plurality of preceding sheets can also be checked to see whether the sheets respectively preceding in the predetermined processing sequence have already been removed or are still present in the corresponding input compartments.

In a somewhat simplified implementation of the inventive method, the removal sequence can be adapted to the filling status or statuses of individual input compartments as soon as it has been detected that at least one of the input compartments is almost empty. For example, the drive of the individual compartments is then modified such that the removal sequence with respect to the sheets to be taken from the individual input compartments is brought approximately or completely into agreement with the processing sequence. This then results therein that the distances between individual sheets become greater but the processing sequence can be dependably adhered to. A certain advantage can also be seen therein that the input compartment reported as almost empty can be completely emptied without the processing sequence being thereby negatively influenced.

Under particular use conditions, however, it can also be expedient to immediately stop the electrophotographic printer and copier operations as soon as it has been found that at least one of the input compartments is almost empty.

This measure, however, would presumably be practiced only in comparatively rare cases.

For implementation of the inventive method, each input compartment has a sensor allocated to it that outputs the signal that a compartment is almost empty as soon as only approximately twenty sheets or less are still present in the input compartment. According to the invention, the sensor is connected to a control unit that changes or, respectively, increases the time spacings between the sheets that are removed from the individual input compartments when a signal that a compartment is almost empty is adjacent, as a result whereof the processing sequence is ultimately adhered to.

A second sensor, for example in the form of a light barrier, is also preferably allocated to each input compartment, this outputting a signal as soon as the input compartment is completely empty.

The invention is explained in greater detail below with reference to the attached drawings.

DESCRIPTION OF THE PREFERRED EMBODIMENTS

Figure 1:
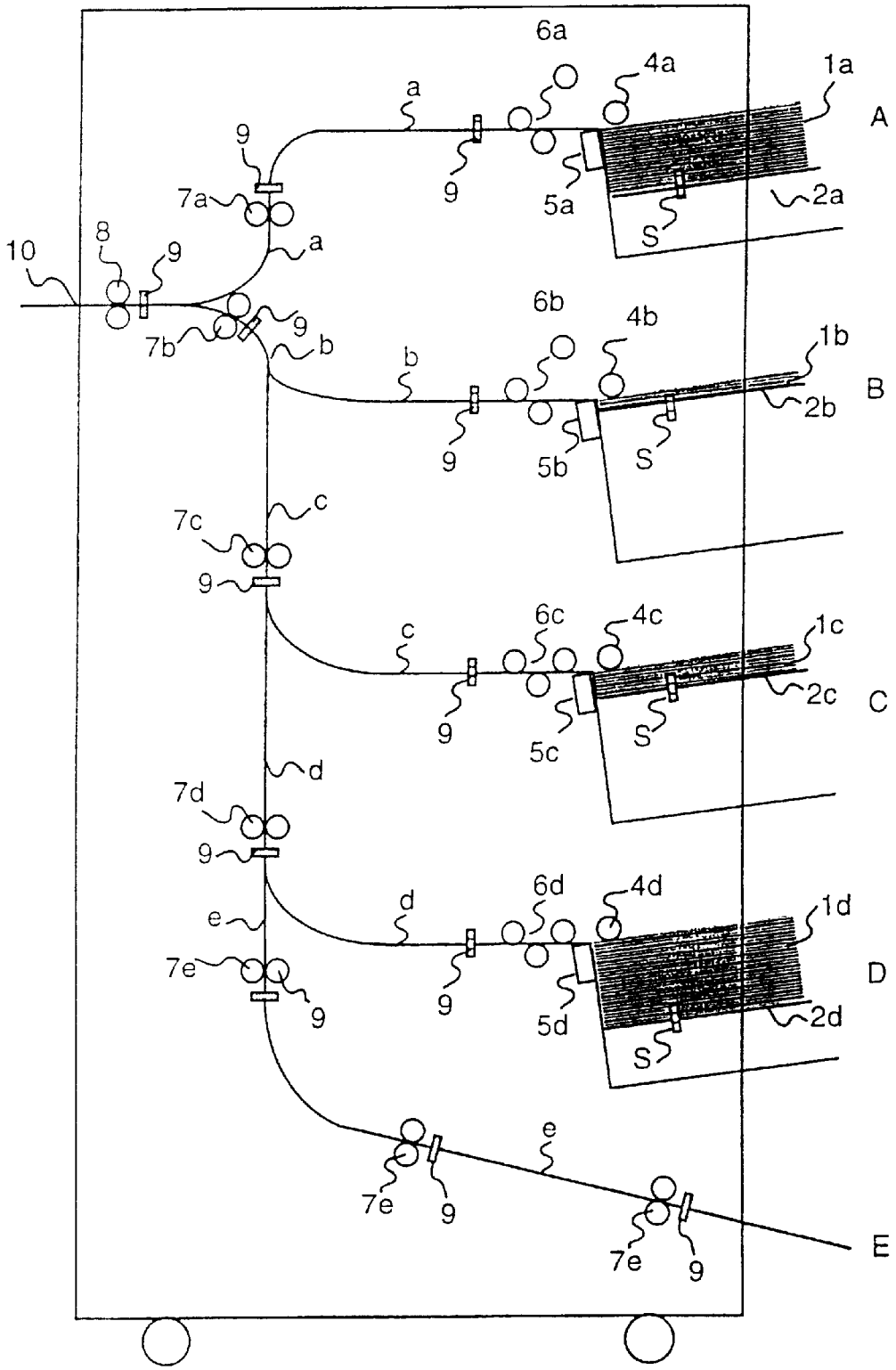
FIG. 1 is a paper output means with a plurality of input compartments of a printer and copier device.

In FIG. 1, a paper output means comprises a plurality of input compartments A through D as well as an external draw-in E. Respective sheet stacks 1*a* through 1*d* are accommodated in the input compartments A through D. The sheet stacks 1*a* through 1*d* are pressed up against sheet removal devices 4*a* through 4*d* by lifter means 2*a* through 2*d*. Respective sensors 5*a* through 5*d* are also arranged at the input compartments A through D, these outputting a signal as soon as the corresponding compartment of the compartments A through D is almost empty. Further, a respective sensor S is arranged at the floor of the compartments A through D, this outputting signal when the respective compartment is empty.

Sheets that have been taken from the respective input compartments A through D with the sheet removal devices 4*a* through 4*d* allocated to these compartments are transported with conveyor devices 6*a* through 6*d* and 7*a* through 7*d* on conveying paths a through d and are finally taken by a further conveyor means 8, proceeding from which the sheets are conveyed to a sheet transfer location 10 at which the sheets are handed over from the paper output means to a printer and copier device (not shown).

Sheets introduced at the external draw-in E are conveyed with conveyor means 7*e* along a conveying path e until they are taken by the conveyor means 7*d* that is provided at the end of the conveying path d. Light barriers 9 are provided at various locations in the conveying paths a through e for monitoring the conveying.

Given an automatic sheet output, one sheet that has been removed from a sheet stack 1*a* accommodated in the compartment A with the sheet removal means 4*a* is conveyed, for example, along the conveying path a with the conveyor means 6*a*, 7*a* and 8, to the sheet transfer location 10. Analogously thereto, sheets removed from the input compartments B, C and D are conveyed to the sheet transfer location 10 along the conveying paths b through d with the conveyor devices 6*b*, 7*b*, 8 or, respectively 6*c*, 7*c*, 7*b*, 8 and 6*d*, 7*d*, 7*c*, 7*b* and 8.

As can be derived from FIG. 1, the conveying path b of the conveying paths a through d from the input compartments A through D up to the sheet transfer location 10 is the shortest and the conveying path d is the longest.

Figure 3:
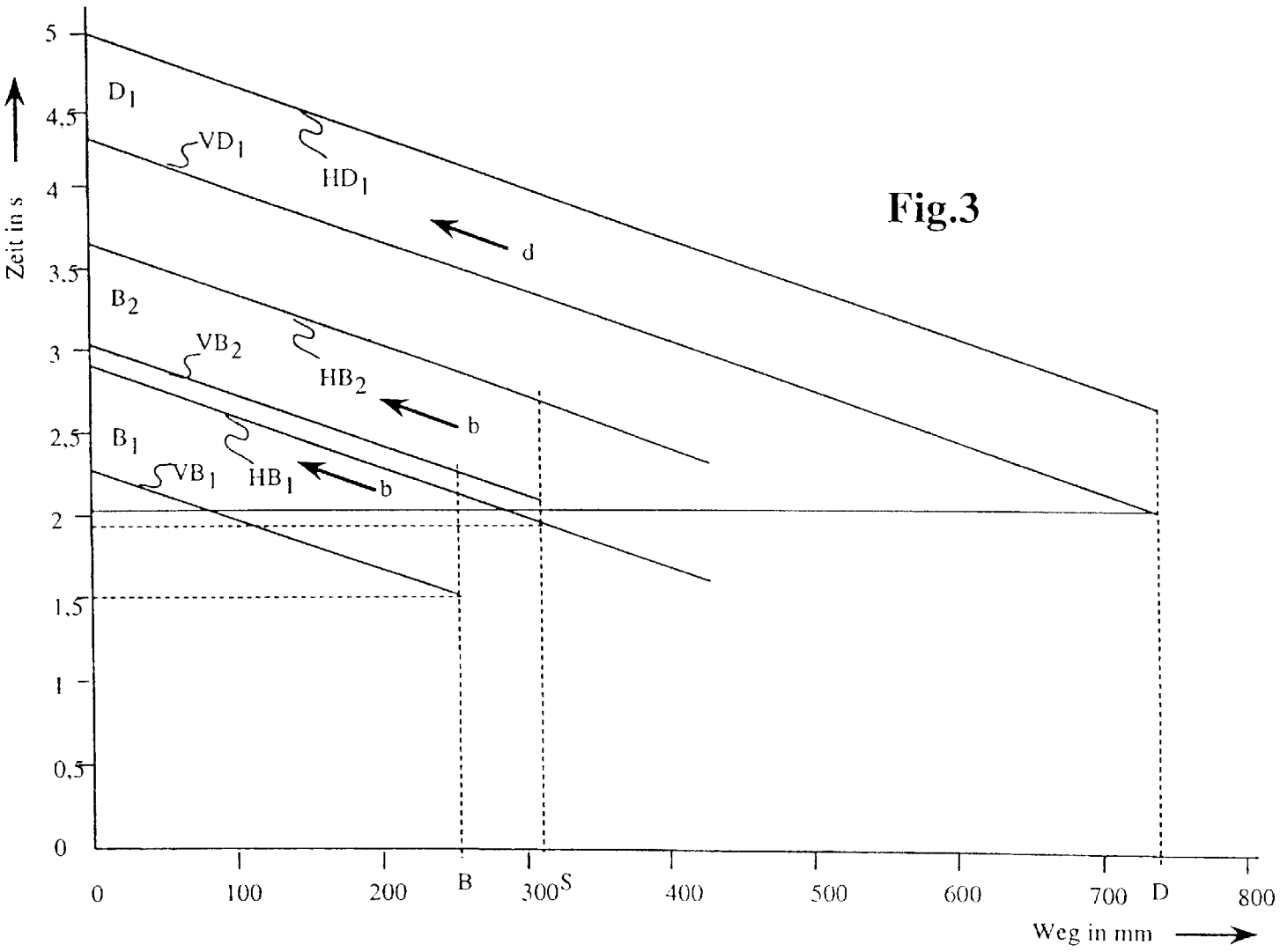
FIG. 3 is a control diagram for controlling the output of sheets from input compartments of the paper output means, whereby the inventive method is realized therein.

FIG. 3 shows a diagram of a controller that works according to the inventive method. In FIG. 3, various times are likewise again entered on the ordinate in seconds (s) and the length of conveying paths is entered on the abscissa in mm. A sheet processing sequence $B_1$-$B_2$-$D_1$ should also be adhered to in the diagram illustrated in FIG. 3.

Figure 2:
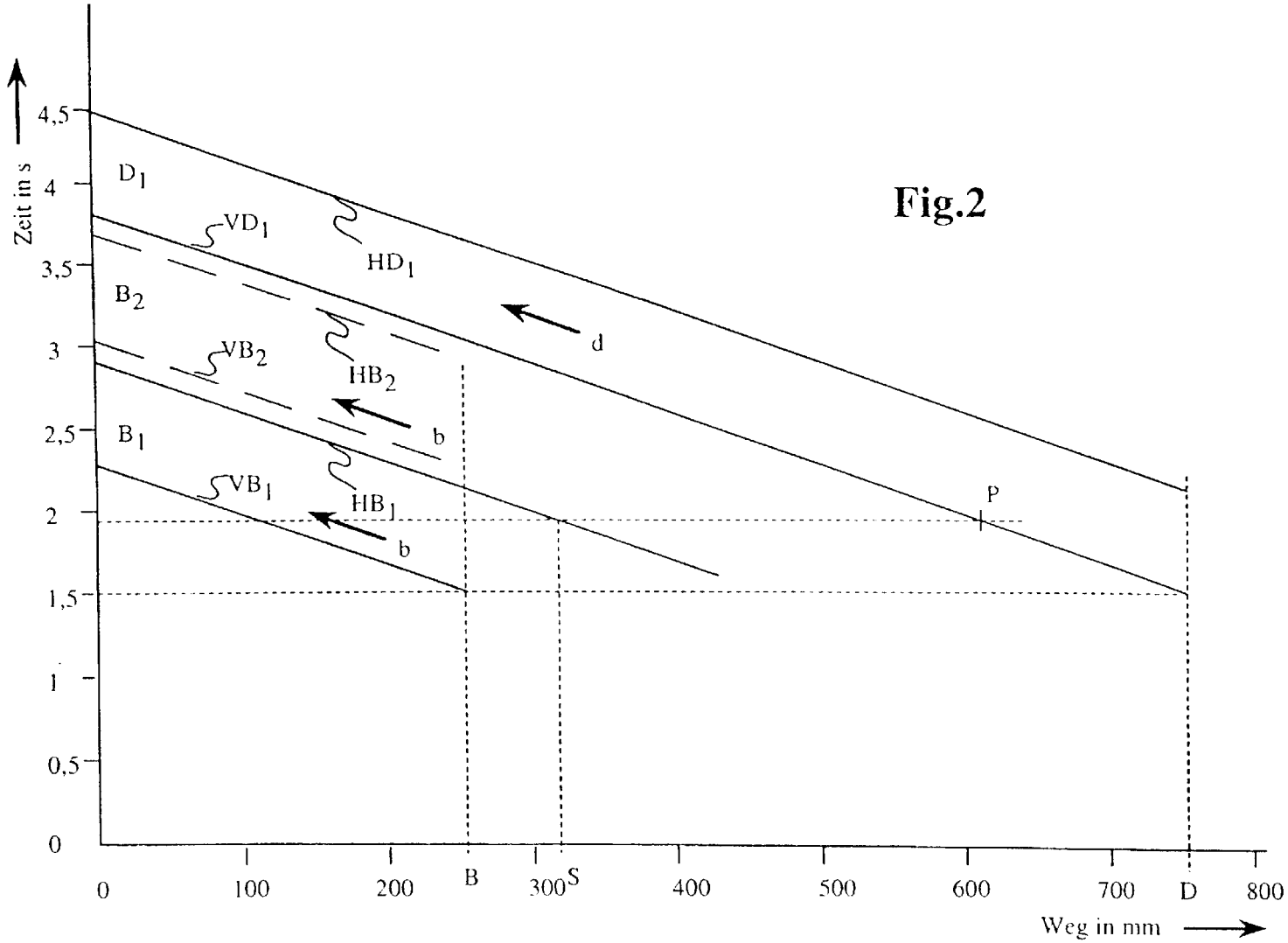
FIG. 2 is a possible control diagram for controlling the output of sheets from input compartments of a paper output means of a printer and copier device.

Differing from the possible control described with reference to FIG. 2, however, a sensor, for example the sensor 5*b* is assumed to have indicated that the input compartment B is almost empty. The inventive method comes to bear as soon as the finding has been made that an input compartment is almost empty.

In the present case, this means that sheet $B_1$ is again removed, for example at the time 1.5 s. The sensor S allocated to the compartment B detects, for instance at time 1.9 s, that the compartment B is not yet empty after the removal of the sheet $B_1$ or, respectively, that at least one sheet is still present.

Immediately thereafter, for instance at time 2.1 s, the sheet removal means 4*d* of the compartment D is driven. The sheet $D_1$ is removed and conveyed in the direction to the sheet transfer location 10 on the conveying path d indicated by a directional arrow. At approximately time 2.3 s, the sheet $B_2$ is also removed with the sheet removal means 4*b* and is conveyed in the direction to the sheet transfer location 10 on the conveying path b identified with a directional arrow.

Since the sheet $D_1$ is taken delayed from the compartment D with reference to the sheet $B_2$ and was handed over to the conveyor devices 6*d*, but the second sheet $B_2$ was taken from the compartment B without delay, a larger space has arisen between the sheet $B_2$ and the sheet $D_1$.

If, following the removal of the sheet $B_1$, the sensor S had reported that the compartment B is now empty, no sheet from the paper stack 1*d* accommodated in the compartment D would have been removed from the compartment D.

As can be derived from the diagram in FIG. 3, thus, the printing sequence $B_1$-$B_2$-$D_1$ is thus reliably assured in the printer and copier device. Due to the response of the sensor 5*b* allocated to the compartment B, this having indicated that the compartment B is almost empty, the space or, respectively, the gap between the sheet $B_2$ and the sheet $D_1$ is merely greater until the compartment B in the described example is in fact empty.

LIST OF REFERENCE CHARACTERS

| | |
|---|---|
| 10 | Sheet transfer location |
| 1a through 1d | Sheet stack |
| 2a through 2d | Lifter means |
| 4a through 4d | Sheet removal means |
| 5a through 5d | Sensor (almost empty) |
| 6a through 6d | Conveyor means |
| 7a through 7d | Conveyor means |
| 7e | Conveyor means |
| 8 | Conveyor means |
| 9 | Light barrier |

-continued

| LIST OF REFERENCE CHARACTERS | |
|---|---|
| a through d | Conveying path |
| E | External draw-in |
| e | Conveying path |
| S | Sensor (empty) |

We claim:

1. Method for controlling the output of sheets from input compartments of a sheet output means of a printer or copier device, said method comprising the steps of:

taking the sheets from the various input compartments in a sheet removal sequence different from a sheet processing sequence in which the device processes the sheets, carrying out a check to see whether a minimum plurality of sheets is still contained in the input compartment from which the next sheet to be processed according to the processing sequence is taken and whether the input compartment is to be defined as almost empty, and when the input compartment that has been checked has been defined as almost empty, carrying out a check to see whether a sheet is still present in the input compartment defined as almost empty before starting the next removal sequence.

2. Method according to claim 1, characterized in that the printer or copier operation is interrupted when a sheet is no longer present in the input compartment defined as almost empty without taking the sheet to be removed next in the removal sequence.

3. Method for controlling the output of sheets from input compartments of a sheet output means of a printer or copier device, said method comprising the steps of:

monitoring the number of sheets in each input compartment to determine when a compartment is almost empty, removing the sheets in a sheet removal sequence which differs from a sheet processing sequence only until it has been found that at least one of the input compartments is almost empty, and then switching the sheet removal sequence to be the same as the sheet processing sequence as soon as at least one of the input compartments is almost empty.

4. Method according to claim 3, characterized in that, given at least one almost empty input compartment, the next sheet according to the processing sequence is only taken when a sheet to be processed before the next sheet according to the processing sequence has already been taken or is still present in the corresponding input compartment, and in that the printer or copier operations are stopped when an input compartment is empty.

5. Method according to claim 4, characterized in that the sheet in the processing sequence to be processed before the next sheet lies immediately in front of the next sheet.

6. Method according to claim 3, wherein a signal that a compartment is almost empty is generated as soon as approximately twenty sheets are present in an input compartment.

7. Sheet output means for a printer or copier device, comprising at least two input compartments for the acceptance of sheets, a removal means provided at each input compartment for removing a respective single sheet from the respective input compartment, controller means for actuating the removal means that prescribes a sheet removal sequence in which the removal means take the sheets from the various input compartments and checks whether at least one of the input compartments is defined as almost empty, and a sheet transfer location in communication with the removal means via conveying paths for transferring the sheets to the device in a sheet processing sequence prescribed by the controller means, the improvement comprising the removal sequence differs from the processing sequence, and the controller means only activates the removal means of an input compartment that is defined as almost empty and from which the next sheet in the removal sequence is to be taken after the controller means has checked whether a sheet is still present in the input compartment defined as nearly empty.

8. Sheet output means according to claim 7, wherein a sensor is allocated to each input compartment, said sensor outputting a signal to the controller means as soon as the input compartment to which it is allocated is almost empty.

9. Sheet output means according to claim 8, wherein the controller means changes the time spacings between the sheets removed from the individual input compartments when a signal generated by an activated sensor is received.

10. Sheet output means according to claim 8 wherein a second sensor, is arranged in every input compartment, said second sensor generating a signal as soon as the input compartment allocated to it is empty.

11. Sheet output means according to claim 10, wherein each second sensor is a light barrier.

12. Sheet output means for a printer or copier device, comprising at least two input compartments for the acceptance of sheets, a removal means provided at each input compartment for removing a respective single sheet from the respective input compartment, controller means for actuating the removal means that prescribes a sheet removal sequence in which the removal means take the sheets from the various input compartments and checks whether at least one of the input compartments is to be defined as almost empty, and a sheet transfer location in communication with the removal means via conveying paths for transferring the sheets to the device in a sheet processing sequence prescribed by the controller means, the improvement comprising the controller means prescribes a removal sequence that differs from the processing sequence until at least one of the input compartments is defined as almost empty, and the controller means then modifies the removal sequence according to the processing sequence as soon as at least one of the input compartments is defined as almost empty.

13. Sheet output means according to claim 12, wherein a sensor is allocated to each input compartment, said sensor outputting a signal to the controller means as soon as the input compartment to which it is allocated is almost empty.

14. Sheet output means according to claim 13, wherein the controller means changes the time spacings between the sheets removed from the individual input compartments when a signal generated by an activated sensor is received.

15. Sheet output means according to claim 13, wherein a second sensor is arranged in every input compartment, said second sensor generating a signal as soon as the input compartment allocated to it is empty.

16. Sheet output means according to claim 15, wherein each second sensor is a light barrier.

* * * * *